US009878187B2

(12) United States Patent
Sargent et al.

(10) Patent No.: US 9,878,187 B2
(45) Date of Patent: Jan. 30, 2018

(54) JOIST ANCHOR

(71) Applicant: ROOFTOP ANCHOR, INC, Heber City, UT (US)

(72) Inventors: Nathan M. Sargent, Heber City, UT (US); Kynan D. Wynne, Heber City, UT (US); Tyson M. Munford, Heber City, UT (US); Joshua P. Adam, Heber City, UT (US); Braxton T. Schindler, Heber City, UT (US)

(73) Assignee: ROOFTOP ANCHOR, INC., Heber City, UT (US)

( * ) Notice: Subject to any disclaimer, the term of this patent is extended or adjusted under 35 U.S.C. 154(b) by 0 days.

(21) Appl. No.: 14/959,988

(22) Filed: Dec. 4, 2015

(65) Prior Publication Data

US 2017/0157438 A1 Jun. 8, 2017

(51) Int. Cl.

| | |
|---|---|
| ***A47L 3/04*** | (2006.01) |
| ***A62B 35/00*** | (2006.01) |
| ***E04G 21/32*** | (2006.01) |

(52) U.S. Cl.

CPC ..... *A62B 35/0068* (2013.01); *E04G 21/3261* (2013.01)

(58) Field of Classification Search

CPC ..... E04G 21/3261; A62B 35/0068
USPC ..... 182/3, 36
See application file for complete search history.

(56) References Cited

U.S. PATENT DOCUMENTS 1,912,872 A * 6/1933 Trautner ..... B60R 25/00 70/231
2,095,289 A * 10/1937 Rosenberg ..... F16B 37/14 138/96 T
3,217,833 A * 11/1965 Smith ..... E04G 21/3261 182/3
4,078,271 A * 3/1978 Tambascio ..... A47C 19/024 248/188
4,249,713 A * 2/1981 Glynn ..... A62B 35/04 182/3
4,767,091 A * 8/1988 Cuny ..... A62B 35/04 182/3

(Continued)

FOREIGN PATENT DOCUMENTS

| | | |
|---|---|---|
| FR | 2824578 | 11/2002 |
| GB | 2219826 | 12/1989 |

(Continued)

OTHER PUBLICATIONS

GE Protection Inc.; Guardian Fall Protection; Permanent Adjustable Standing Seam Roof Anchor; Retrieved on May 28, 2015: http://www.guardianfall.com/performance-safety-products/anchor-points/commercial-anchor-points/permanent-adjustable-standing-seam-roof-anchor; 2 pgs.

(Continued)

*Primary Examiner* — Kimberly Wood

(74) *Attorney, Agent, or Firm* — Fabian VanCott; Brian J. Riddle

(57) ABSTRACT

A system for mounting a stanchion on a structure includes a base plate, a stanchion coupled to the base plate, and a number of base plate flanges coupled to the base plate. The base plate flanges to couple the base plate to at least one joist of the structure. The stanchion protrudes through the surface of the structure to a first side of the structure while the base plate and the base plate flanges remain on a second side of the surface of the structure.

18 Claims, 6 Drawing Sheets

(56) References Cited

U.S. PATENT DOCUMENTS 4,784,555 A * 11/1988 Cantrell ..... F16B 37/14 403/372
4,907,929 A * 3/1990 Johnston, Jr. ..... F16B 37/14 411/377
5,011,106 A * 4/1991 Cody ..... A62B 35/0068 182/3
5,137,112 A * 8/1992 Nichols ..... A62B 35/0043 182/3
5,165,499 A * 11/1992 Bell ..... A62B 35/0068 182/9
5,248,021 A * 9/1993 Nichols ..... A62B 35/04 182/3
5,346,036 A * 9/1994 Arisman ..... A62B 35/04 182/3
5,442,887 A 8/1995 Welsh
5,553,685 A * 9/1996 Cook ..... A62B 35/0068 182/3
5,595,260 A * 1/1997 Jalla ..... A62B 35/0068 182/3
5,636,704 A * 6/1997 Castaneda ..... A62B 1/14 182/192
5,687,535 A * 11/1997 Rohlf ..... A62B 35/0068 248/505
5,699,875 A * 12/1997 Dugan ..... A62B 35/0068 182/3
5,727,646 A * 3/1998 Gray ..... E04G 21/3261 182/3
5,730,245 A * 3/1998 Conway ..... A62B 35/0068 182/3
5,730,407 A * 3/1998 Ostrobrod ..... A62B 35/0043 182/231
5,758,742 A * 6/1998 Chiou ..... E04G 5/04 182/3
6,668,509 B1 * 12/2003 Krebs ..... E04G 21/3261 248/499
6,763,910 B2 7/2004 Cole
6,786,020 B2 * 9/2004 Poldmaa ..... A62B 35/0068 182/45
6,966,531 B2 * 11/2005 Curtin ..... E04G 21/3261 182/3
7,000,730 B1 2/2006 Ostrobrod
7,163,083 B2 * 1/2007 Argoud ..... A62B 35/04 182/113
7,240,770 B2 * 7/2007 Mullins ..... E04G 21/3261 182/3
7,380,373 B2 * 6/2008 Crookston ..... E04G 21/3261 182/45
7,832,153 B2 * 11/2010 Crookston ..... E04C 3/17 182/45
8,028,477 B2 * 10/2011 Crookston ..... E04C 3/17 182/45
8,511,036 B2 8/2013 O'Donnell
9,003,715 B2 4/2015 Nurdogan
2005/0189171 A1 9/2005 Bos
2006/0096238 A1 * 5/2006 Mullins ..... E04G 21/3261 52/749.12
2006/0120825 A1 * 6/2006 Miyazaki ..... F16B 37/14 411/372.6
2006/0156645 A1 * 7/2006 Munday ..... A62B 35/0068 52/122.1
2007/0144830 A1 * 6/2007 Mastenbroek ..... A62B 35/0056 182/3
2007/0272811 A1 11/2007 Baake
2010/0133040 A1 * 6/2010 London ..... A62B 1/04 182/3
2011/0250024 A1 * 10/2011 Mirabile ..... E21D 11/006 405/288
2013/0087669 A1 4/2013 Daddio
2014/0123568 A1 * 5/2014 Nurdogan ..... E04D 1/30 52/57

FOREIGN PATENT DOCUMENTS

GB 2251020 7/1995
WO 1994017261 8/1994
WO 1994028268 12/1994

OTHER PUBLICATIONS

Roof Edge Fabrications; Cost Effective Pitched Roof Safety Solution; Slope Roof Mounted Anchors; http://www.roofedge.co.uk/products/info/Cost-effective-pitched-roof-safety-solution; 2 pgs; retrieved on May 28, 2015.
Miller by Honeywell; Miller Fusion Roof Anchor Post; Permanent or Temporary Solution for Roof Safety; Retrieved on May 28, 2015; https://www.millerfallprotection.com/fall-protection-products/roofing-products/miller-fusion-roof-anchor-post; 3 pgs.

* cited by examiner

JOIST ANCHOR

BACKGROUND

People working on the tops and sides of buildings, as well as other high structures, risk falling and suffering injury as a result. In modern society, building construction and building maintenance are areas that continue to expose workers to the risk of dangerous falls. According to the U.S. Department of Labor, work related falls are among the most common sources of work related severe injuries and death. (See, e.g., https://www.osha.gov/SLTC/fallprotection/). The Department of Labor's Bureau of Labor Statistics reports that slips, trips and falls resulted in approximately 229,000 injuries per year (2011-2013) resulting in approximately 700 workplace deaths per year. Death from falls is second only to vehicle related deaths and account for roughly 16% of work related deaths. OSHA and ANSI I-14 provide standards to reduce the number and severity of workplace falls. Fall protection equipment must, perform under a wide variety of conditions while not hindering the ability of the workers to safely perform their jobs.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
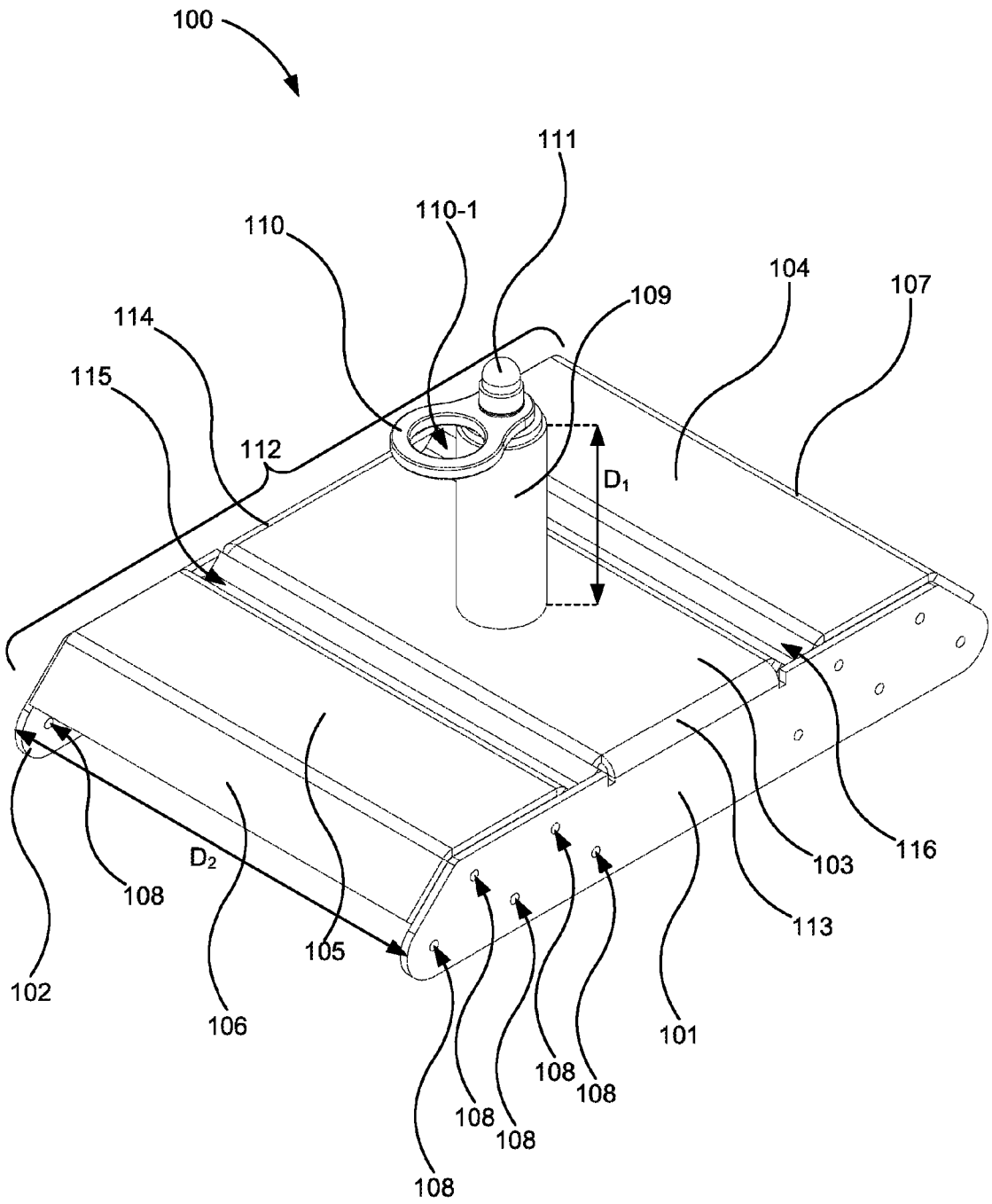
FIG. 1 is an isometric view of a joist anchor, according to one example of the principles described herein.

Fall protection devices are devices that assist in protecting users from falling off structures such as buildings. These fall protection devices seek to prevent a fall from structures by securing the user to anchors coupled to the structure such as the roof. Fall arrest devices are devices that protect users from experiencing forces on their bodies that may result in serious bodily injury or death. The fall arrest devices seek to minimize the severity and duration of an impact force experienced during a fall event. These devices are often required and regulated by the Occupational Safety and Health Administration (OSHA) that function under a number of laws and regulations such as Title 29 of the Code of Federal Regulations. Further, industries standards may be provided by private, non-profit organizations such as the American National Standards Institute (ANSI). For example, guidance and testing parameters for fall protection and fall arrest devices are provided by the ANSI Z-359 Fall Protection Code.

Occupational Safety and Health Administration (OSHA) is an area concerned with the safety, health, and welfare of people engaged in work or employment. The goals of occupational health and safety programs include fostering a safe and healthy work environment. OSHA may also protect co-workers, family members, employers, customers, and many others who might be affected by the workplace environment. Thus, OSHA seeks to protect any individual who may use devices such as a stanchion that provides a secure tie down while accessing a rooftop area, for example. Due to the distances that may separate a roof of a structure from a ground floor or other elevation below the roof, an individual accessing the roof area may be in significant danger as to loss of life or limb if a fall should occur. Thus, a fall protection system that secures an individual while accessing the roof of the structure significantly reduces or eliminates any death or injuries that may otherwise be experienced during such activities.

Examples described herein provide a system for mounting a stanchion on a structure. The system includes a base plate, a stanchion coupled to the base plate, and the base plate coupled to the base plate flange. The base plate flange connects the base plate to two joists of the structure. The stanchion protrudes through the surface of the structure to a first side of the structure while the base plate and base plate flange remains on a second side of the surface of the structure.

In one example, the base plate is bent on two sides at 90° to the main section of the base plate. This forms two "flanges" of the base plate which may, in one example, be located on the opposite side of the base plate from one another. The base plate may be coupled to the base plate flanges.

In one example, the system includes weatherproofing material coupled to the stanchion on a first side of the structure around the stanchion to prevent passage of moisture from the first side of the structure to the second side of the structure. The system further includes at least one stanchion loop coupled to the stanchion.

A number of apertures are defined in the base plate flange. A number of coupling devices couple the base plate flange to the joists of the structure via the apertures.

In one example, the base plate includes a number of telescoping sub-elements to extend the width of the base plate to interface with at least two separate joist of the structure. In one example, the telescoping sub-elements include a number of cams formed in a first base plate flange, and a number of cam apertures defined within the base plate. The cams are slidably coupled to the base plate via the cam apertures.

Examples described herein further provide a joist anchor. The joist anchor includes a base plate, and a stanchion coupled to the base plate. The joist anchor further includes a number of flanges coupled to the base plate. The flanges couple to at least one joist under a surface a structure. The joist anchor further includes a loop coupled to the stanchion to secure a user to the stanchion. The joist anchor further includes a loop fastener to couple the loop to the stanchion. Further, in one example, a loop fastener cover may be coupled to the loop fastener to protect the loop fastener from corrosive environmental elements.

The base plate and the base plate flange of the joist anchor coupled to the base plate may be dimensioned to span a length between two adjacent joists within the structure. Further, when the joist anchor is installed, the base plate runs parallel to a wall of the structure, and the base plate flange runs parallel to the joists.

The joist anchor may further include a number of apertures defined in the base plate flange. A number of coupling devices may be inserted into the apertures to couple the base plate flange to the structure. In one example, the joist anchor further includes a number of ridges defined within the base plate to strengthen the base plate.

In one example, the base plate of the joist anchor includes a number of telescoping sub-elements to extend the width of the base plate to interface with at least two separate joist of the structure. The telescoping sub-elements include a number of cams formed in a first base plate flange, and a number of cam apertures defined within the base plate. The cams are slidably coupled to the base plate via the cam apertures.

Examples described herein further provide a method of installing a joist anchor. The method includes protruding a stanchion through an aperture in a surface of a structure. The stanchion may be coupled to a base plate. The method further includes coupling a number of base plate flanges to a corresponding number of joists. The base plate flanges may be coupled to the base plate.

The method may further include coupling a stanchion loop to the stanchion to secure a user to the stanchion. Further, the method may include weatherproofing the stanchion to prevent passage of moisture from a first side of the structure to a second side of the structure.

In one example, the base plate includes a number of cams formed in a first base plate flange, and a number of cam apertures defined within the base plate. The cams are slidably coupled to the base plate via the cam apertures. In this example, the method further includes extending the first base plate flange to a first joist, and extending the second base plate flange to a second joist.

The method further includes coupling the number of base plate flanges to a corresponding number of joists and a corresponding number of nailer boards. The nailer boards may be located on opposite sides of the joists relative to each of the number of base plate flanges. In one example, the method may further include placing a number of spacers between the number of base plate flanges and the number of joists to fill gaps between the base plate flanges and joists.

As used in the present specification and in the appended claims, the term "coupled," "coupled to" or similar language is meant to be understood broadly as joining or connecting two or more elements. Coupling elements together may be achieved using any number of coupling devices or processes. Coupling devices may include fasteners of any kind, such as, for example, bolts, clamps, hooks, joints, keepers, latches, locking devices, lugs, nails, nuts, pins, rivets, and screws, among other fastening devices, or combinations thereof. Further, coupling processes may include, for example, welding, and using chemical bonds such as glues, among other coupling processes, or combinations thereof.

As used in the present specification and in the appended claims, the term "joist" or similar language is meant to be understood broadly as any of a number of parallel beams of timber, steel, reinforced concrete, or other materials, for supporting floors, walls, ceilings, or other portions of a structure.

As used in the present specification and in the appended claims, the term "environmental elements" or similar language is meant to be understood broadly as any agency or force that may act on the joist anchor of the present application. Environmental elements include, for example, precipitation, electromagnetic emissions from the sun, wind or other weather-related elements.

Even still further, as used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may not be included in other examples.

Figure 2:
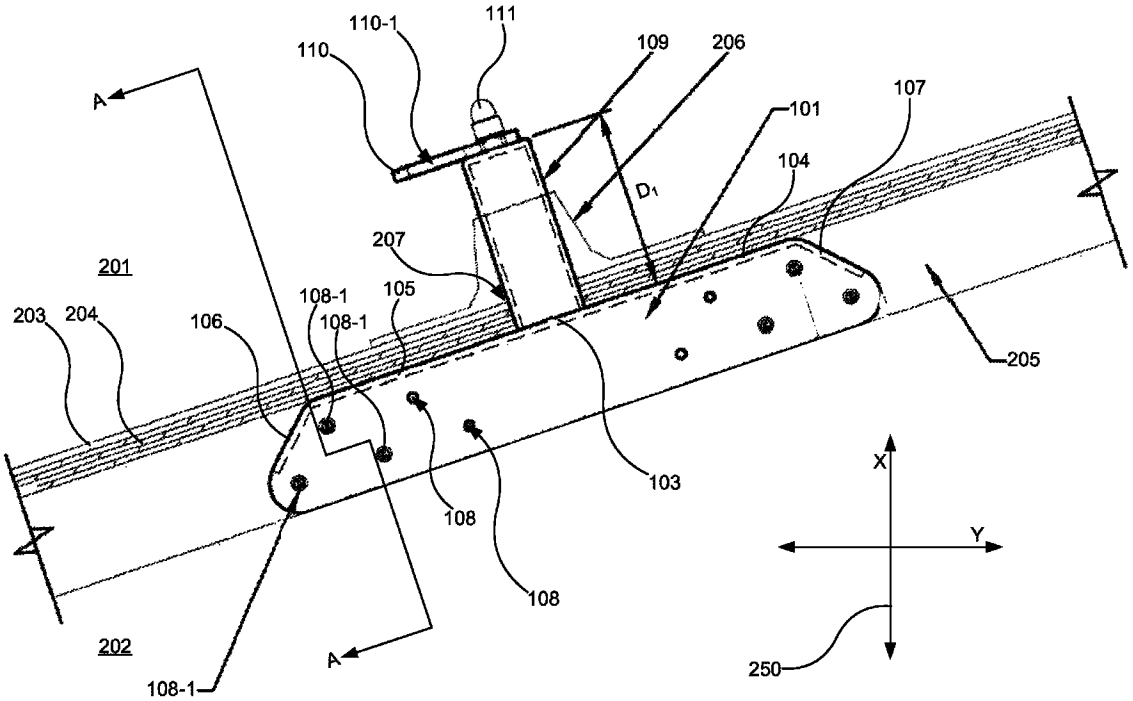
FIG. 2 is a side elevation view of a joist anchor, according to another example of the principles described herein.
Figure 3:
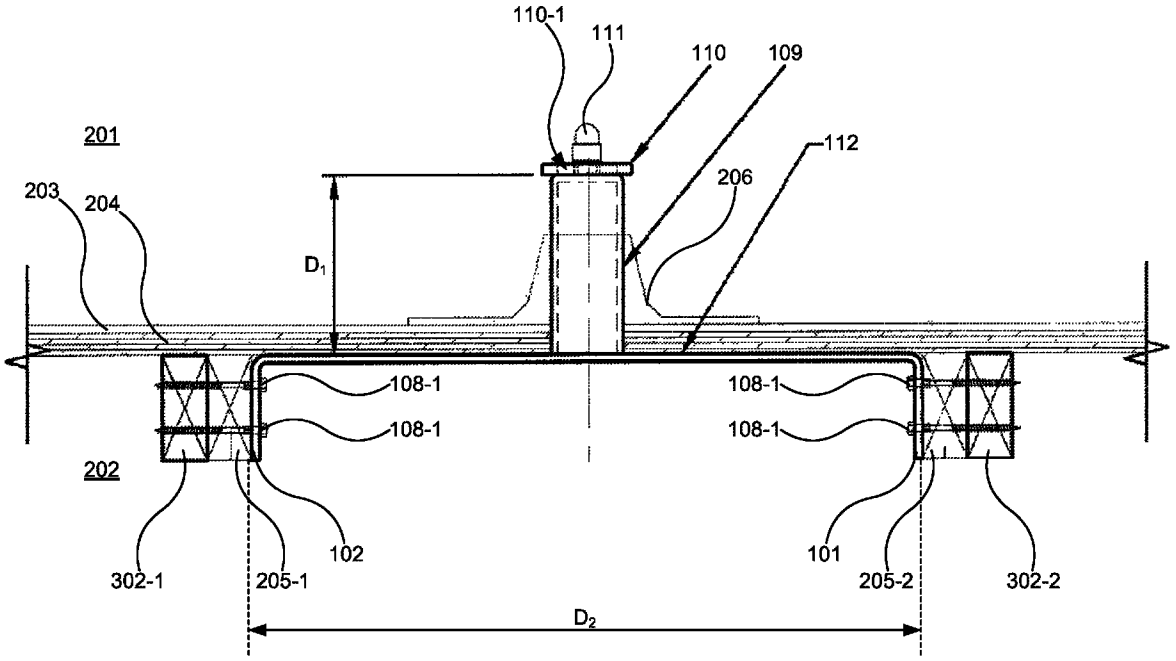
FIG. 3 is a front cut-away view of the joist anchor along line A of FIG. 2, according to one example of the principles described herein.
Figure 4:
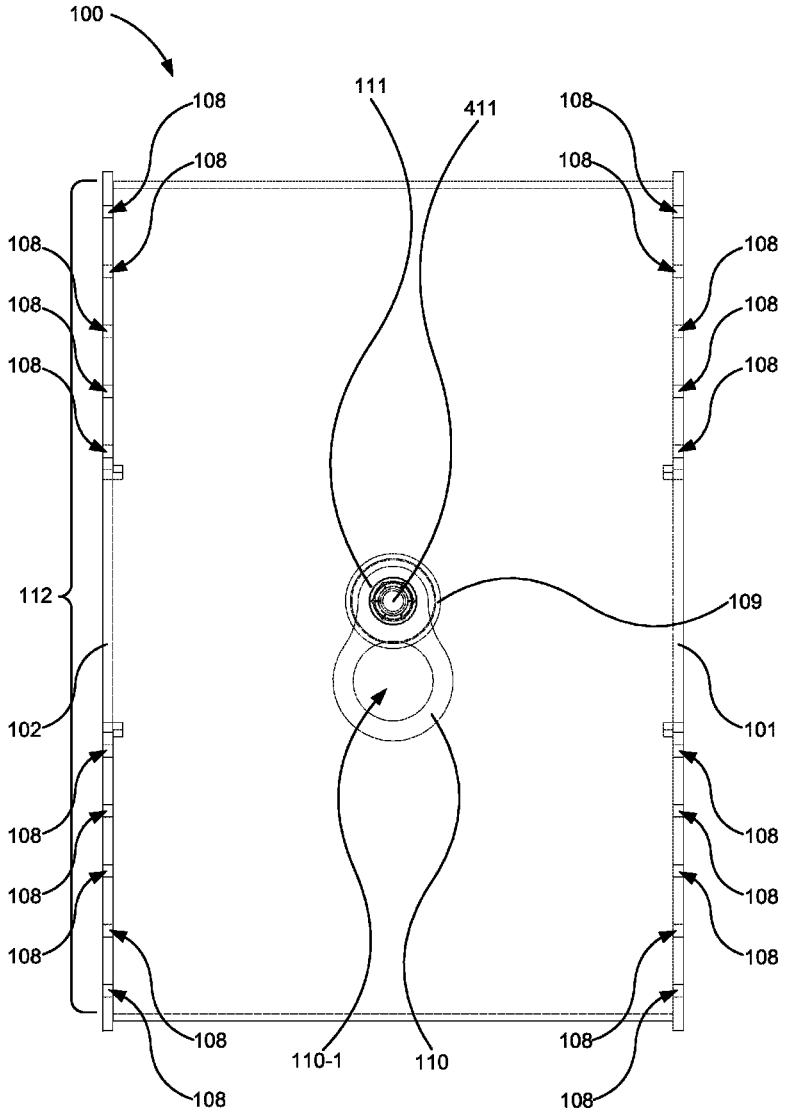
FIG. 4 is a top view of the joist anchor, according to one example of the principles described herein.
Figure 5:
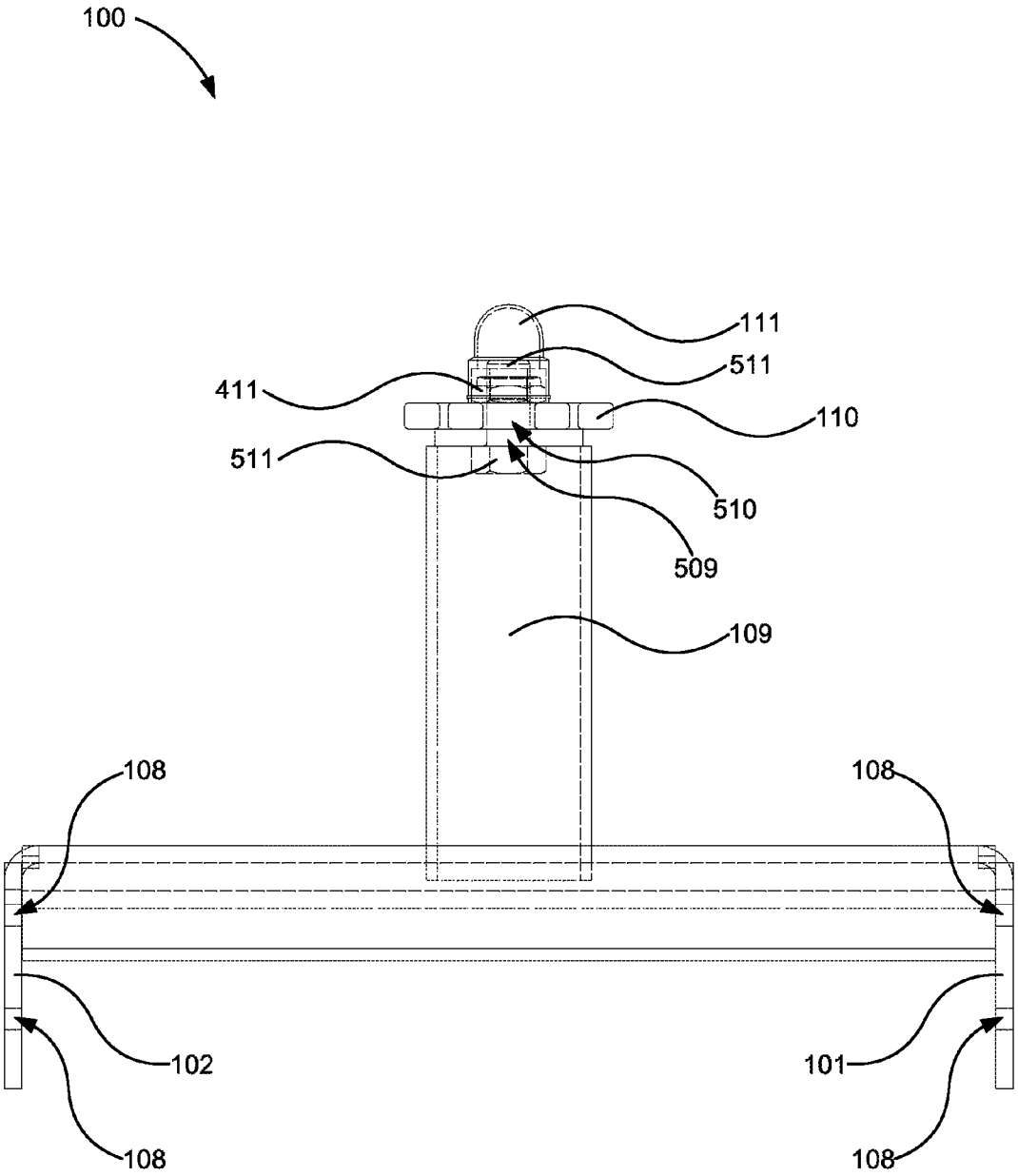
FIG. 5 is a back cut-away view of the joist anchor, according to one example of the principles described herein.
Figure 6:
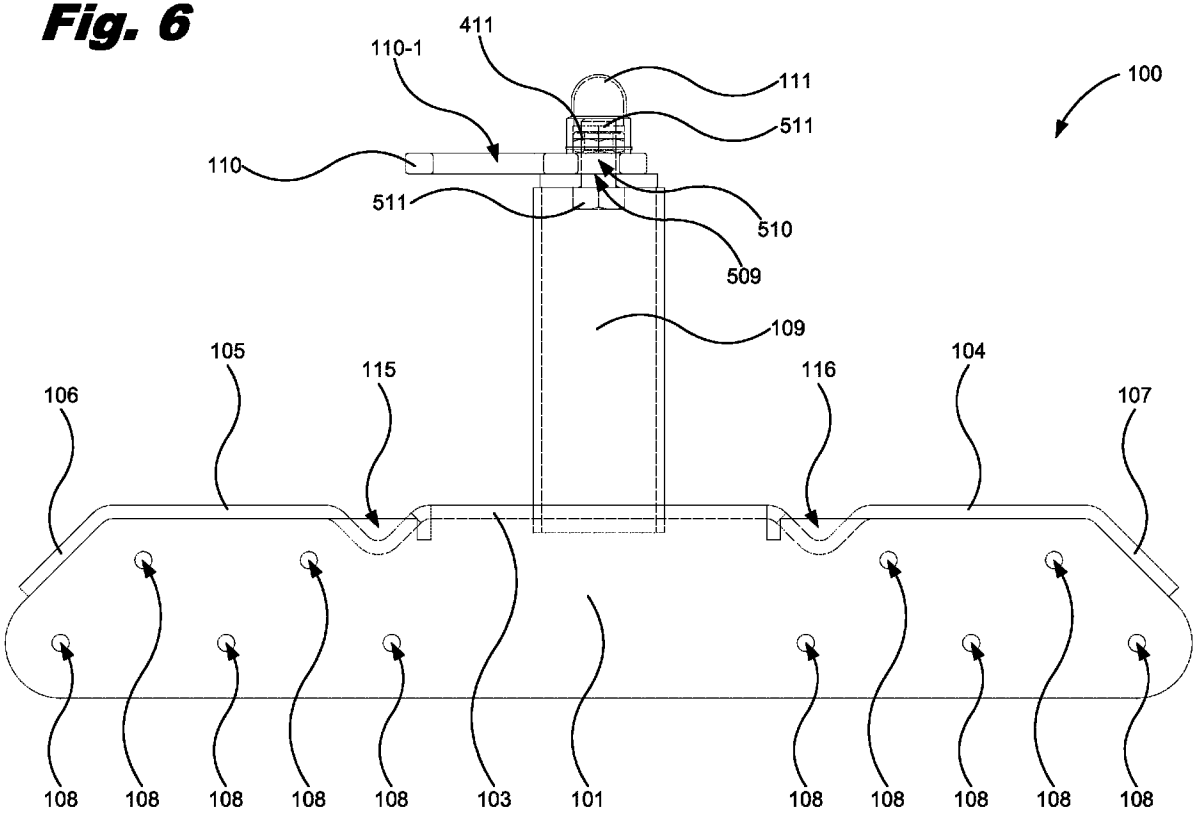
FIG. 6 is a side view of the joist anchor, according to one example of the principles described herein.

Turning now to the figures, FIG. 1 is an isometric view of a joist anchor (100), according to one example of the principles described herein. FIG. 2 is a side elevation view of a joist anchor (100), according to another example of the principles described herein. FIG. 3 is a front cut-away view of the joist anchor (100) along line A of FIG. 2, according to one example of the principles described herein. FIG. 4 is a top view of the joist anchor (100), according to one example of the principles described herein. FIG. 5 is a back cut-away view of the joist anchor (100), according to one example of the principles described herein. FIG. 6 is a side view of the joist anchor (100), according to one example of the principles described herein. Reference numbers are used throughout the drawings to designate similar elements.

The joist anchor (100) serves as an anchor to which a rope, cable, or other lifeline is tethered. The lifeline is then secured to a user via, for example, a harness attached to the user. In this manner, the joist anchor (100) secures an individual to a roof or other portion of a building or other structure so that injury to the user as a result of a fall from the structure is significantly reduced or eliminated. In one example, the joist anchor (100) may be installed on a non-horizontal plane such as a pitched roof such as the pitched roof depicted in FIG. 2 with respect to the X-Y plane (250). A pitched roof presents a number of additional challenges as to user safety due to the risk of slipping towards the edge of the roof and the user's inability to balance on a pitched roof relative to a flat roof.

The joist anchor (100) includes a base plate (112), a stanchion (109) coupled to the base plate (112), and a number of base plate flanges (101, 102) coupled to the base plate (112). The base plate flanges (101, 102) couple to two joists (205) under a surface such as a roof deck (FIGS. 2 and 3, 203, 204) of the structure. A loop (110) is coupled to the stanchion (109) to secure a user to the stanchion (109).

In one example, a very large portion of the joist anchor (100) is installed under a roof deck (FIGS. 2 and 3, 203, 204) as depicted in FIGS. 2 and 3. The roof deck (FIGS. 2 and 3, 203, 204) may include, for example, a wood layer (204) and a shingle layer (203) disposed therein. However, any type of building and roof materials may be used as roofing for the structure. The under-mounted joist anchor (100) and its ability to be mounted under the roof deck (FIGS. 2 and 3, 203, 204) serves to keep the roof clear of ancillary portions of an anchor device from obstructing the roof top and keeps these obstructions out of under the user's feet. Thus, the joist anchor (100) reduces trip hazards due to the under-mounting thereof.

Further, the ability to mount the joist anchor (100) under a roof deck (FIGS. 2 and 3, 203, 204) of a structure adds significant strength to the joist anchor (100) and the overall system. The roof deck (FIGS. 2 and 3, 203, 204) acts as an additional anchoring or barrier structure because the base plate interfaces, at least in part, with the interior side (FIGS.

2 and 3, 202) of the roof deck (FIGS. 2 and 3, 203, 204). This is in addition to the number of base plate flanges (101, 102) that are coupled to joists (205-1, 205-2, collectively referred to as 205) located under the roof deck (FIGS. 2 and 3, 203, 204).

In one example, the base plate (112) is not coupled to the interior side (FIGS. 2 and 3, 202) of the roof deck (FIGS. 2 and 3, 203, 204). In this example, the base plate (112) may be installed against the interior side (FIGS. 2 and 3, 202) of the roof deck (FIGS. 2 and 3, 203, 204) but not coupled to the interior side (FIGS. 2 and 3, 202) using, for example, any number of fasteners. Instead, the base plate flanges (101, 102) coupled to the base plate (112) are coupled to joists (205) located on the interior side (FIGS. 2 and 3, 202) of the roof deck (FIGS. 2 and 3, 203, 204) such that the base plate (112) abuts the interior side (FIGS. 2 and 3, 202). This ensures that the roof deck (FIGS. 2 and 3, 203, 204) remains impermeable from moisture or other environmental elements that may otherwise occur if a fastener coupling the base plate to the interior side (FIGS. 2 and 3, 202) penetrates through a portion or the entirety of the roof deck (FIGS. 2 and 3, 203, 204). For example, if a fastener such as, for example, a screw, penetrates the shingle layer (FIGS. 2 and 3, 203) of the roof deck (FIGS. 2 and 3, 203, 204), then moisture from precipitation may penetrate the shingle layer (FIGS. 2 and 3, 203) and cause damage to the structure and objects inside the structure.

In another example, the base plate (112) is coupled to the interior side (FIGS. 2 and 3, 202) of the roof deck (FIGS. 2 and 3, 203, 204). In this example, the base plate (112) may be installed against the interior side (FIGS. 2 and 3, 202) of the roof deck (FIGS. 2 and 3, 203, 204) and coupled to the interior side (FIGS. 2 and 3, 202). In one example, the base plate (112) may be installed against the interior side (FIGS. 2 and 3, 202) of the roof deck (FIGS. 2 and 3, 203, 204) using, for example, any number of fasteners that do not penetrate the entire thickness of the roof deck (FIGS. 2 and 3, 203, 204). This ensures that the roof deck (FIGS. 2 and 3, 203, 204) remains impermeable from environmental elements. In another example, the base plate (112) may be installed against the interior side (FIGS. 2 and 3, 202) of the roof deck (FIGS. 2 and 3, 203, 204) using, for example, glues that adhere the base plate (112) to the interior side (FIGS. 2 and 3, 202) of the roof deck (FIGS. 2 and 3, 203, 204).

Still further, the ability to mount the joist anchor (100) under a roof deck adds to the aesthetic properties of the structure by not requiring bulky portions of the joist anchor (100) to be exposed to people viewing the structure. This may be especially advantageous when the structure is built, at least in part, because of its architectural qualities. The examples of the joist anchor (100) described herein do not significantly detract from architectural qualities of the structure.

The various elements of the joist anchor (100) will now be described in more detail. The base plate (112), in some examples depicted herein such as in FIGS. 1, 2, and 6, may include a number of surfaces (103, 104, 105, 106, and 107) and a number of ridges (115, 116) defined within a number of the surfaces (103, 104, 105, 106, and 107) of the base plate (112). The surfaces (103, 104, 105, 106, 107) may be coupled to the base plate flanges (101, 102) using any of number of coupling devices or processes including, for example, the use of fasteners of any kind or through welding. In another example, the surfaces (103, 104, 105, 106, and 107) and the base plate flanges (101, 102) are formed from the same piece of material, and shaped or formed as described herein.

The number of surfaces (103, 104, 105, 106, and 107) may be formed along the length of the base plate (112) in order to provide strength to the joist anchor (100). In one example, the surfaces (103, 104, 105, 106, and 107) are formed at angle respective to one another. For example, surfaces 106 and 107 may be formed at an angle with respect to surfaces 103, 104, and 105. The formation of angles among the surfaces (103, 104, 105, 106, and 107) imparts additional strength to the base plate (112) in a perpendicular direction relative to the direction of the angles between the surfaces (103, 104, 105, 106, and 107).

In one example, the base plate (112) may further include a number of ridges (115, 116) defined therein as depicted in FIGS. 1 and 6. Ridges (115, 116) are embossed lines or formed channels that run across the surface of the base plate (112). The ridges (115, 116) compound the strength of the base plate (112). The stretched or deformed metal in the area of the ridges (115, 116) hold tension in the panel and give it structural rigidity. In one example, the ridges (115, 116) are formed in the base plate (112) using a bead roller. The ridges (115, 116) add strength to the base plate in a direction parallel and perpendicular to the ridges (115, 116). The figures are depicted with and without ridges (115, 116). For example, FIGS. 1, 5, and 6 depict examples of the joist anchor (100) that include the ridges (115, 116), whereas FIGS. 2-4 are depicted without ridges (115, 116).

The width of the joist anchor (100) including the base plate (112) and the number of base plate flanges (101, 102) may be formed to fit between joists, studs, beams, rafters, trusses, or similar structures that create parallel-running elements between which the joist anchor (100) may be installed. This fit is depicted in FIG. 3, for example. These structures will be collectively referred to in the present specification and in the appended claims as joists (205). Thus, the distance ($D_2$) between the outer edges of the base plate flanges (101, 102) of the joist anchor (100) may be, for example, 12 inches (in.), 16 in., 24 in., 36 in., or other distances engineered within the structure between joists (205).

The base plate flanges (101, 102) are coupled to the base plate (112) in order to couple the joist anchor (100) to the structure. The base plate flanges (101, 102) may be made of any material sufficiently strong enough to bear stresses associated with a load placed on the joist anchor (100). In one example, the base plate flanges (101, 102) may be made of galvanized steel. Because the base plate flanges (101, 102) are included among the number of elements of the joist anchor (100) that are to be mounted under a roof deck (FIGS. 2 and 3, 203, 204) and not exposed to environmental elements, in one example, the material from which the base plate flanges (101, 102) are made may not need to be a material that can withstand these environmental elements. However, in another example, the base plate flanges (101, 102) may be made of a material that can withstand the environmental elements in case precipitation, for example, penetrates the roof deck (FIGS. 2 and 3, 203, 204).

The base plate flanges (101, 102) coupled to the base plate (112) may include a number of apertures (108) defined in the base plate flanges (101, 102). The apertures (108) may be defined in the base plate flanges (101, 102) using, for example, a drilling or stamping process. A number of coupling devices (108-1) depicted in FIGS. 2 and 3 may be used to couple the base plate flanges (101, 102) to two joists (205-1, 205-2) of the structure via the apertures. In one example, the coupling devices (108-1) are screws such as, for example, a lag screw that will penetrate the joist (205-1, 205-2), a number of nailer boards (302-1, 302-2), or combinations thereof. However, any coupling device (108-1) may be used to couple the base plate flanges (101, 102) to the joist (205-1, 205-2). More details regarding the coupling of the base plate flanges (101, 102) to the joist (205-1, 205-2) will be described in more detail below.

As mentioned above, the stanchion (109) is coupled to the base plate (112). The stanchion (109) may be coupled to the base plate (112) using any number of different coupling devices or coupling processes as described herein. In one example, the stanchion (109) is coupled to the base plate (112) using a bolt and nut coupling system. In another example, the stanchion (109) is coupled to the base plate (112) using a welding process. The stanchion (109) is depicted throughout the Figures as being coupled to the center of the base plate (112). However, the stanchion (109) may be coupled to the base plate (112) at any position along the surface of the base plate (112).

The stanchion (109) includes a height ($D_1$). In one example, the height ($D_1$) is large enough to cause a top portion of the stanchion (109) to protrude through a roof deck (FIGS. 2 and 3, 203, 204). In one example the height ($D_1$) is approximately 6 in. The stanchion (109) may be made of any material that may be subjected to environmental elements including, for example, precipitation without degradation of the stanchion (109) and its load bearing properties. In one example, the stanchion (109) may be made of galvanized steel.

A loop (110) is coupled to the stanchion (109) as mentioned above. Like the stanchion (109), the loop (110) may be made of any material that may be subjected to environmental elements including, for example, precipitation without degradation of the loop (110) and its load bearing properties. In one example, the loop (110) may be made of stainless steel. A tethering aperture (110-1) is defined in the loop (110). The tethering aperture (110-1) is used to tether a rope, cable, or other lifeline between a user and the joist anchor (100).

The loop (110) is coupled to the stanchion (109) using, for example, a bolt (511) and a nut (411) as depicted in FIGS. 4, 5, and 6. The bolt (511) may be threaded through a stanchion aperture (509) and a loop aperture (510), and coupled to the nut (411). A nut cap (111) that seals the bolt (511) and nut (411) from exposure to the environmental elements may be coupled to the nut (411), the loop (110), or a combination thereof. Any number of weatherproofing may be applied to the interface between the nut cap (111) and the nut (411) and/or the loop (110) to ensure that water from precipitation does not enter the stanchion aperture (509) and loop aperture (510).

The stanchion (109) and loop (110) are designed to withstand significant loads placed thereon during a fall event when a user falls from the structure while tethered to the joist anchor (100). In one example, the stanchion (109) and loop (110) may have a 1,800 pound (lb.) arrest load capacity and a 3,600 lb. ultimate load capacity. In another example, the stanchion (109) and loop (110) may be designed to meet any number of engineering standards.

As mentioned above, FIG. 2 is a side elevation view of the joist anchor (100), according to another example of the principles described herein, and FIG. 3 is a front cut-away view of the joist anchor along line A of FIG. 2, according to one example of the principles described herein. As depicted in FIGS. 2 and 3, a weatherproofing material (206) may be coupled to the stanchion (109) on the first side (201) of the structure around the stanchion (109) to prevent passage of moisture from the first side (201) of the structure to the second side (202) of the structure. In one example, the weatherproofing material (206) is a rubber or plastic that hermetically seals the stanchion (109) and the roof deck (203, 204). This seal prevents serves to ensure that moisture does not penetrate from the first side (201) of the structure to the second side (202) of the structure via a roof aperture (207) through which the stanchion (109) protrudes.

As mentioned above, FIG. 3 is a front cut-away view of the joist anchor (100) of FIG. 2 along line A of FIG. 2, according to one example of the principles described herein. A number of nailer boards (302-1, 302-2) may be used to couple the base plate flanges (101, 102) to the joists (205-1, 205-2). As depicted in FIG. 3, for example, the nailer boards (302-1, 302-2) may be placed on sides of the joists (205-1, 205-2) opposite the base plate flanges (101, 102). When installing the joist anchor (100), the coupling devices (108-1) depicted in FIGS. 2 and 3 penetrate both the joists (205-1, 205-2) and the nailer boards (302-1, 302-2).

In one example, the nailer boards (302-1, 302-2) are wood two-by-fours. In another example, the nailer boards (302-1, 302-2) are made of a metal. In this example, the coupling devices (108-1) may be bolts and nuts where the bolts penetrate through the joists (205-1, 205-2) and the nailer boards (302-1, 302-2), and the nuts are attached to the bolts. In still another example, the joist anchor (100) may be installed without the use of the nailer boards (302-1, 302-2).

In one example, the base plate (112) includes a number of telescoping sub-elements to extend the width of the base plate (112) to interface with at least two separate joist of the structure. In this example, the telescoping sub-elements include a number of cams formed in a first flange (101, 102), and a number of cam apertures defined within the base plate (112). The cams are slidably coupled to the base plate (112) via the cam apertures. In this manner, the flanges (101, 102) are able to extend to neighboring joists or similar structures in the case that the individuals who constructed the structure constructed the joists to have slightly larger distance there between instead of, for example, an industry standard or any distance other than distance ($D_2$) between the outer edges of the base plate flanges (101, 102) of the joist anchor (100).

The specification and figures describe a system for mounting a stanchion on a structure includes a base plate, a stanchion coupled to the base plate, and a number of base plate flanges coupled to the base plate. The base plate flanges to couple the base plate to at least one joist of the structure. The stanchion protrudes through the surface of the structure to a first side of the structure while the base plate and the base plate flanges remain on a second side of the surface of the structure. This system safely secures a user to a rooftop pursuant to a number of industry regulations while maintaining aesthetics of a structure to which the system is installed.

The preceding description has been presented to illustrate and describe examples of the principles described. This description is not intended to be exhaustive or to limit these principles to any precise form disclosed. Many modifications and variations are possible in light of the above teaching.

The status and content of each claim follows.

What is claimed is:

1. A system for mounting a stanchion on a structure comprising:

a base plate, the base plate comprising:

a plurality of surfaces; and a number of ridges defined in the surfaces;

a stanchion coupled to the base plate, the stanchion comprising a cylindrical cross-section;

at least one attachment device removably coupled to the stanchion, the attachment device comprising at least one tethering aperture defined therein;

a number of base plate flanges coupled to the base plate, the base plate flanges to couple the base plate to at least two joists of the structure, wherein the stanchion permanently protrudes through the surface of the structure to a first side of the structure while the base plate and the base plate flanges remain on a second side of the surface of the structure; and a weatherproofing material coupled to the stanchion on the first side of the structure around the stanchion to prevent passage of moisture from the first side of the structure to the second side of the structure, wherein the plurality of surfaces comprise:

a first surface perpendicular to the stanchion and the base plate flanges; and at least a second surface formed at a first acute angle with respect to the first surface and relative to a side of the first surface adjacent the stanchion, wherein the attachment device is oriented in a plane parallel to the plane of the base plate such that the tethering aperture opens in a direction parallel to a longitudinal axis of the stanchion, and wherein at least one of the ridges defined in the surfaces comprises:

a second acute angle deviating from the plane of the surfaces;

a return directed back to the plane of the surfaces; and a third acute angle deviating from the plane of the surfaces, the second acute angle, return, and third acute angle forming a channel, the channel running in a direction perpendicular to the base plate flanges and the stanchion.

2. The system of claim 1, wherein the base plate comprises a first base plate flange and a second base plate flange, the first base plate flange coupled to the base plate on an opposite side of the base plate relative to the second base plate flange.

3. The system of claim 1, wherein the base plate flanges are perpendicularly coupled to the base plate.

4. The system of claim 1, further comprising:

a number of apertures defined in the number of base plate flanges; and a number of coupling devices to couple the base plate flanges to the at least two joists of the structure via the apertures.

5. The system of claim 1, wherein the distance between the base plate flanges is approximately equal to the distance between the at least two joists of the structure.

6. A joist anchor comprising:

a base plate;

a stanchion coupled to the base plate, the stanchion comprising a cylindrical cross-section;

at least one attachment device removably coupled to the stanchion, the attachment device comprising at least one tethering aperture defined therein; and a number of base plate flanges coupled to the base plate, the base plate flanges to couple to at least two joists under a surface of a structure;

wherein the stanchion permanently protrudes through the surface of the structure to a first side of the structure while the base plate and the base plate flanges remain on a second side of the surface of the structure; and a weatherproofing material coupled to the stanchion on the first side of the structure around the stanchion to prevent passage of moisture from the first side of the structure to the second side of the structure, wherein the base plate comprises:

a plurality of surfaces comprising:

a first surface perpendicular to the stanchion and the base plate flanges; and at least a second surface formed at a first acute angle with respect to the first surface and relative to a side of the first surface adjacent the stanchion, wherein the attachment device is oriented in a plane parallel to the plane of the base plate such that the tethering aperture opens in a direction parallel to a longitudinal axis of the stanchion, and at least one ridge defined in the first surface, the ridge comprising:

a second acute angle deviating from the plane of the first surface;

a return directed back to the plane of the first surface; and a third acute angle deviating from the plane of the first surface, the second acute angle, return, and third acute angle forming a channel, the channel running in a direction perpendicular to the base plate flanges and the stanchion.

7. The joist anchor of claim 6, further comprising:

a loop fastener to couple the attachment device to the stanchion; and a loop fastener cover coupled to the loop fastener to protect the loop fastener from environmental elements.

8. The joist anchor of claim 6, wherein the base plate and the base plate flanges coupled to the base plate, are dimensioned to span a length between two adjacent joists of the at least two joists within the structure.

9. The joist anchor of claim 6, wherein, when the joist anchor is installed:

the base plate runs parallel to a wall of the structure, and the base plate flanges run parallel to the joists.

10. The joist anchor of claim 6, further comprising:

a number of apertures defined in the base plate flanges, wherein a number of coupling devices are inserted into the apertures to couple the base plate flanges to the joists of the structure.

11. The joist anchor of claim 6, further comprising a number of said at least one ridge defined within the base plate to strengthen the base plate, the ridges being formed perpendicular to a force applied in the stanchion.

12. The joist anchor of claim 6, wherein the distance between the base plate flanges is approximately equal to the distance between the joist of the structure.

13. A method of installing a joist anchor comprising:

protruding a stanchion through an aperture in a surface of a structure, the stanchion coupled to a base plate, the base plate comprising:

a plurality of surfaces; and a number of ridges defined in the surfaces, wherein the plurality of surfaces comprise:

a first surface perpendicular to the stanchion and two base plate flanges; and at least a second surface formed at a first acute angle with respect to the first surface and relative to a side of the first surface adjacent the stanchion, and wherein at least one of the ridges defined in the surfaces comprises:

a second acute angle deviating from the plane of the surfaces;

a return directed back to the plane of the surfaces; and a third acute angle deviating from the plane of the surfaces, the second acute angle, return, and third acute angle forming a channel, the channel running in a direction perpendicular to the base plate flanges and the stanchion;

coupling the base plate flanges to a corresponding number of joists, the base plate flanges coupled to the base plate;

coupling an attachment device to the stanchion to secure a user to the stanchion;

weatherproofing the stanchion to prevent passage of moisture from a first side of the structure to a second side of the structure.

14. The method of claim 13, further comprising coupling the base plate flanges to the joists and a corresponding number of nailer boards, the nailer boards being located on opposite sides of the joists relative to each of the number of base plate flanges.

15. The method of claim 13, wherein coupling the base plate flanges to the joists comprises coupling a number of coupling devices to the joists via a number of apertures defined in the base plate flanges.

16. The system of claim 1, wherein the attachment device is coupled to the stanchion using a bolt and nut, and wherein a nut cap is coupled to the nut to prevent the bolt and nut from exposure to environment elements.

17. The joist anchor of claim 6, wherein the stanchion comprises a cylindrical cross-section.

18. The joist anchor of claim 6, wherein the first surface comprises a plurality of said at least one ridge defined in the first surface, the plurality of ridges dividing the first surface into three sections.

* * * * *